United States Patent [19]

Leonard et al.

[11] 4,307,633

[45] Dec. 29, 1981

[54] ROTARY TOOL

[76] Inventors: Frank G. Leonard; Macy R. Marshall, both of Star Rte. 2, Belle, Mo. 65013

[21] Appl. No.: 182,814

[22] Filed: Aug. 29, 1980

[51] Int. Cl.[3] ..... B25B 13/52

[52] U.S. Cl. ..... 81/64

[58] Field of Search ..... 81/64, 3.43

[56] References Cited

U.S. PATENT DOCUMENTS 2,959,994 11/1960 Kile ..... 81/64

3,686,984 8/1972 Kelso ..... 81/64

*Primary Examiner*—James L. Jones, Jr.

*Attorney, Agent, or Firm*—Emory L. Groff, Jr.

[57] ABSTRACT

A tool for engagement with the periphery of a cylindrical device includes a rigid, outer band supporting a flexible, split, inner band having deflectable, arcuate, distal portions joined by an actuating arm having a free end disposed substantially along an axis extending through the center of the bands and the cylindrical device. A pair of link assemblies having one end fixedly mounted upon the outer band having their opposite ends joined to the inner band distal portions and are slidably engaged by the actuating arm such that arcuate displacement of the arm free end shifts the link assemblies to contract the inner band and produce a rotary displacement of the entire tool.

9 Claims, 6 Drawing Figures

ROTARY TOOL

This invention relates generally to tools and more particularly, to an improved wrench-type tool especially adapted to loosen or tighten cylindrical devices such as automotive oil filters.

Numerous wrenches or the like have been developed in the past to facilitate the removal of oil filters and most of these earlier tools comprise a single split band adapted to be slipped about the cylindrical periphery of the filter and include, a handle or lever radially or tangentially extending from the band and joined by cam means to the ends thereof to permit tightening of the band and arcuate displacement thereof to loosen the filter. Until recently, such arrangements have been quite satisfactory inasmuch as the engine compartments of most motor vehicles were large enough in relation to the size of the engine and accessories to permit application of such wrenches and the subsequent manipulation of the radially extending actuating lever. With the advent of the currently popular compact automobiles, the disposition of the oil filters thereon leaves little room for both application and manipulation of many of the prior types of wrenches in view of the crowded confines of the engine compartment.

By the present invention, an improved tool is provided comprising a pair of bands disposed in a common horizontal plane which need only to be slipped over the bottom-most portion of the cylindrical periphery of an oil filter and which includes, pivoted link assemblies connecting the distal portions of a flexible, split, inner band. These link assemblies are in turn fixed relative an encircling, rigid, outer band and operated by means of a connected actuating arm extending toward the medial portion of the band in a plane below the plane of the bands and thus juxtaposed the bottom or end wall of the oil filter.

To operate the instant tool, it is necessary only to attach a suitable rotary-force-applying tool, such as a socket wrench, which axially engages a tool-engaging head on the lower surface of the rotary actuating arm at its free end whereupon counter-clockwise force applied by the socket wrench arcuately displaces the pair of pivoted link assemblies to cause clamping of the oil filter by the inner split band and subsequent loosening thereof. The symmetrical disposition of the actuating arm and the two link assemblies readily permits use of the subject tool to either loosen or tighten an engaged device. Thus it will be appreciated, that even if an engine oil filter is disposed in an installation allowing of both limited lateral as well as vertical access thereto, use of the subject rotary tool together with an axially extending socket wrench substantially facilitates the removal and replacement of an oil filter since, as is well known to those skilled in the art, the socket of the socket wrench may be combined with appropriate extensions to allow rotary displacement of the socket wrench from a point located a substantial distance beneath the oil filter yet axially aligned with its center.

Accordingly, one of the objects of the present invention is to provide an improved rotary tool comprising a fixed outer supporting band joined to a flexible inner band having a pair of spaced-apart distal portions expanded and contracted with respect to one another by means of a pair of arcuately displaceable link assemblies joining the two bands.

Another object of the present invention is to provide an improved rotary tool for loosening or tightening oil filters engageable about the lowermost portion of a filter and including a dual-segment flexible band the ends of which are contracted and expanded by the arcuate displacement of an actuating arm having a free end extending in a plane beneath the oil filter to a point substantially coincident with the vertical longitudinal axis of the oil filter.

Still another object of the present invention is to provide an improved rotary tool for engagement with the periphery of a cylindrical device and including a contractible flexible band having distal portions joined by a guide channel containing pivot pins attached to the band distal portion and which are arcuately alternately displaced as a connected actuating arm is arcuately displaced in a clockwise or counter-clockwise direction.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
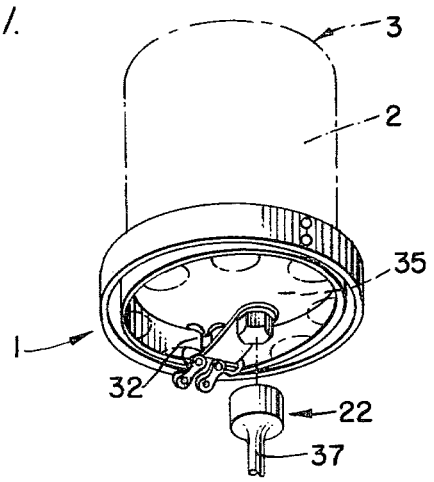
FIG. 1 is a perspective view of the rotary tool of the present invention.
Figure 2:
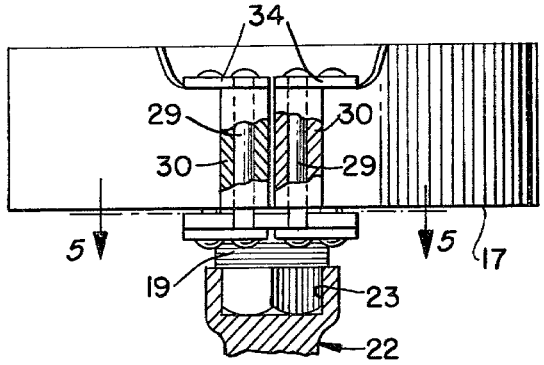
FIG. 2 is an enlarged side elevation, partly in section.

Referring now to the drawing, particularly FIG. 1, the present invention will be understood to comprise a rotary tool, generally designated 1, adapted to engage the cylindrical periphery 2 of a circular device 3 such as an automotive oil filter, in order to apply either a loosening or tightening rotary force upon the filter. The most noteworthy feature of the present tool 1 is that the overall lateral extent or diameter of the tool is only slightly larger than that of the cylindrical device 3 to which it is to be applied and the displaceable actuating means producing a clamping action between the tool and the cylindrical device 3 is substantially fully contained within the confines of the external periphery 4 of the tool. In this manner any suitable rotary-force-applying means, such as a socket wrench, associated with or without an appropriate extension, may be engaged with the tool actuating means in order to rotate same and cause a loosening or tightening of the cylindrical device 3. Those familiar with the art to which the present invention pertains will readily appreciate the significant advantage of being able to loosen or tighten an oil filter without having to manipulate a handle or other actuating means adjacent the periphery 2 of an oil filter situated within the close confines so prevalent with many of today's automotive engine compartments.

The tool 1 includes an outer, cylindrical support band 5 comprising a full circle element of substantially rigid, nondeflectable material and which defines the aforementioned external periphery 4 of the tool. This outer, cylindrical support band 5 serves as means supporting and containing the other components of the tool and contains within its interior surface 6 a split, arcuate, inner band 7 formed of suitable flexible or displaceable material such as spring steel. The medial portion 8 of this band 7 is secured to the interior surface 6 of the outer band 5 at the illustrated anchor point 9, such as by spot welding or by means of rivets while the two distal portions 10—10 of the split, inner band 7 are located substantially diametrically from the anchor point 9 as illustrated most clearly in FIG. 3 of the drawing.

Figure 3:
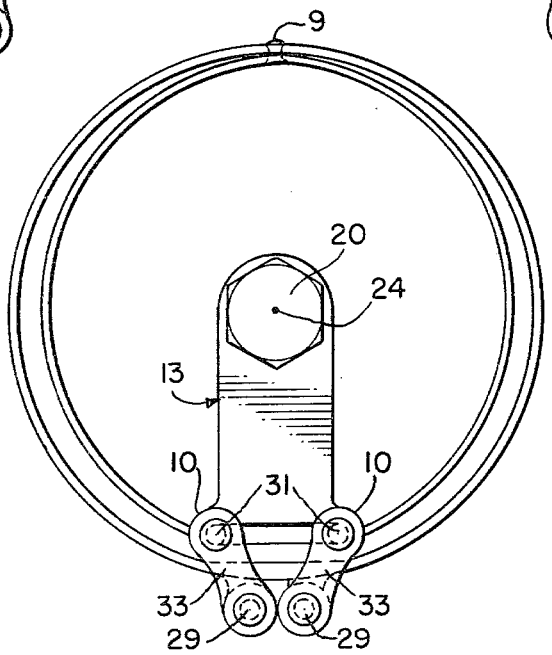
FIG. 3 is a bottom plan view of the tool as it appears in the neutral mode prior to application about the cylindrical periphery of a device to be loosened or tightened.

In an at-rest position the natural resilience of the flexible inner band 7 encourages both the first and second arcuate segments 11 and 12 respectively, of the inner band to be disposed as illustrated in FIG. 3, that is, in a symmetrical radially expanded manner with respect to the adjacent interior surface 6 of the outer cylindrical band 5. The radial movement of the two displaceable arcuate band segments 11–12 is regulated by means of a displaceable actuating arm 13 and a pair of associated link assemblies 14 and 15.

The actuating arm 13 includes a control end 16 disposed below the bottom surface or plane 17 of the two bands 5 and 7 in the area of the distal portions 10 of the inner band 7 while the opposite, free end 18 of the actuating arm is preferable bent downwardly or even further away from the referenced plane 17 for reasons which will become obvious hereinafter. Projecting downwardly from the lower surface 19 of the actuating arm in the area of its free end 18 is an appropriate tool-engaging head 20 having a non-cylindrical periphery 21. This head 20 most preferably comprises a standard hexagonal nut capable of being engaged by a conventional rotary-force-applying tool 22 having a socket 23 mating with the periphery of the head 20. The center axis 24 of the head 20 is located so as to be within the general area of the center longitudinal axis of the cylindrical device 3 to which the tool is to be applied.

Figure 6:
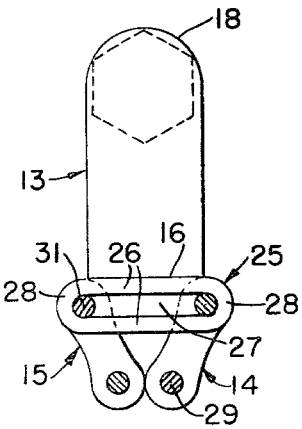
FIG. 6 is a top horizontal view, partly in section, taken along the line 6—6 of FIG. 2.

Arcuate displacement of the actuating arm 13 about the center axis 24 of its head 20 will be understood to produce a magnified arcuate displacement of its control end 16 as well as the attached guide means 25 to which are attached the two link assemblies 14 and 15. As shown most clearly in FIG. 6 of the drawing, the guide means 25 comprises a link guide channel having a pair of parallel side walls 26—26 between which is defined an elongated slot 27 bounded by end walls 28—28 of the guide channel. Both the first link assembly 14 and second link assembly 15 include a stationary pivot pin 29 journaled within a suitable stationary pivot pin support 30 affixed to the outer band 5. Each one of the two link assemblies likewise includes a shiftable pivot pin 31 journaled within a suitable shiftable pivot pin support 32 formed adjacent each of the distal portions 10 of the two segments 11 and 12 of the inner band 7. The two shiftable pivot pins 31 are disposed within the elongated slot 27 of the link guide channel 25 and the two pins 29 and 31 of each link assembly 14 and 15 are respectively joined to one another at both their ends by means of bottom plates 33 and top plates 34.

Figure 4:
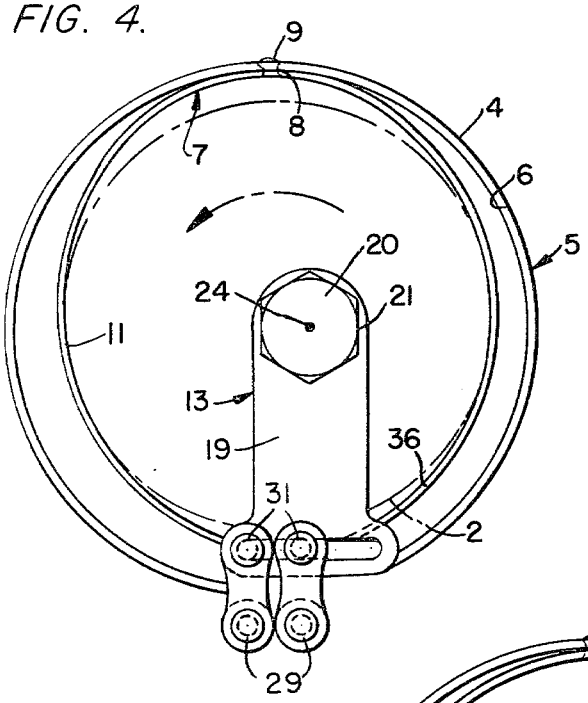
FIG. 4 is a bottom plan view illustrating the tool as it appears while being employed to loosen an article.

With the above description in mind, it will be appreciated that with the rotary tool 1 in the neutral mode of FIG. 3, the two link assemblies 14–15 will be disposed with the shiftable pivot pins 31—31 at the very extreme of the elongated slot 27 of the guide channel 25 such that the flexible band segments 11 and 12 of the inner band 7 will be spaced apart from one another the maximum distance so as to provide the largest diameter to the inner band. In this mode, the tool 1 is slipped over the end wall 35 of the cylindrical device or oil filter 3 until the inner engagement surface 36 of the inner band 7 is juxtaposed the cylindrical periphery 2 of the filter. Then, following application of a socket wrench 22 to the head 20 of the actuating arm 13, a counter-clockwise force applied through the shank 37 of the socket wrench 22 produces a counter-clockwise arcuate displacement of the control end 16 of the actuating arm 13 about its center axis 24 and a corresponding arcuate displacement of the first link assembly 14 from the position as shown in FIG. 3 to the position as shown in FIG. 4 of the drawing. The foregoing action is a direct result of the counter-clockwise arcuate displacement of the left hand end wall 28 of the link guide channel 25 which engages the juxtaposed first shiftable pivot pin 31 and its attached distal portion 10 of the first arcuate inner band segment 11. The foregoing displacement of the first inner band segment 11 effectively reduces the diameter of the split inner band 7 until the inner engagement surface 36 thereof tightly engages the cylindrical periphery 2 of the filter 3 and continued counter-clockwise force applied by the wrench 22 will be understood to produce a concurrent counter-clockwise rotation of the entire rotary tool 1 and the oil filter.

Figure 5:
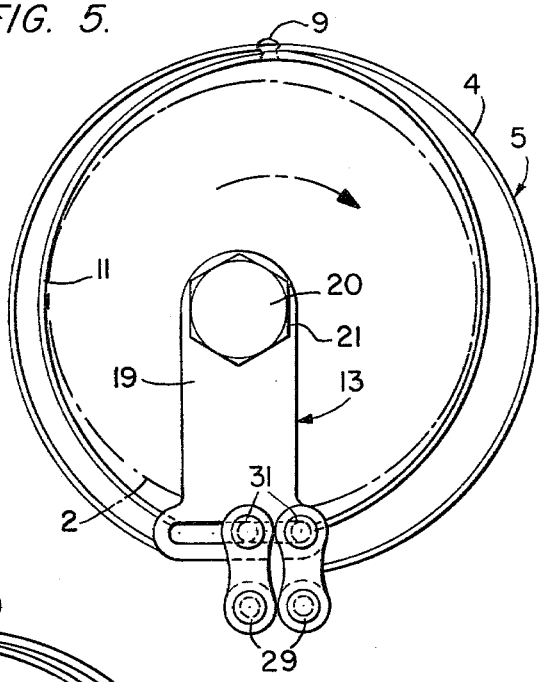
FIG. 5 is a bottom plan view of the tool as it appears when employed to tighten an article.

The unique actuating mechanism of the present invention and the symmetrical provision of the two link assemblies 14–15 permits employment of the tool 1 to not only loosen a tightened cylindrical device but also to reapply and tighten a similar device. The various components of the tool 1 operate in a similar manner when the tool is rotated in a clockwise direction by means of rotation of the socket wrench 22 and this latter arrangement is illustrated in FIG. 5 of the drawing wherein it will be seen that upon a clockwise rotation of the head 20, the control end 16 of the actuating arm 13 is arcuately displaced to the left of the neutral position of FIG. 3 and the radial disposition of the second arcuate inner band segment 12 is shortened and engages the periphery 2 of the cylindrical device 3.

We claim:

1. A rotary tool for engagement with the cylindrical periphery of a device including, a rigid outer band, a displaceable inner band attached to said outer band and having two normally spaced apart distal portions, a pair of link assemblies each having one end pivotally joined to said outer band and another end joined to a respective one of said inner band distal portions, an actuating arm provided with a control end connected to said link assembly another ends and having a free end disposed substantially radially inwardly of said bands, and tool-engaging means on said arm adjacent said free end whereby, application of rotary force to said tool-engaging means arcuately shifts said arm control end and pivotally displaces one said link assembly toward the other link assembly to initially reduce the circumference of said inner band, and subsequently rotate said tool.

2. A rotary tool according to claim 1 wherein, said inner band includes a unitary split band of resilient material normally defining a circumference greater than that of said device to be engaged thereby.

3. A rotary tool according to claim 1 wherein, said link assembly one ends each include a pivot pin journaled at a fixed location relative said outer band.

4. A rotary tool according to claim 1 wherein, said actuating arm includes a lower surface disposed below the horizontal plane of said bands, said tool-engaging means comprising a polygonal head projecting from said lower surface.

5. A rotary tool according to claim 1 wherein, said tool-engaging means is substantially disposed along an axis extending through the center of said bands.

6. A rotary tool according to claim 1 wherein, said actuating arm control end includes a guide channel, said link assembly another ends each including a pivot pin shiftably disposed within said guide channel and journaled within said inner band distal portions.

7. A rotary tool according to claim 1 wherein, said link assembly one ends each include a pivot pin journaled at a fixed location relative said outer band, said actuating arm control end including a guide channel, said link assembly another ends each including a pivot pin shiftably disposed within said guide channel and journaled within said inner band distal portions.

8. A rotary tool according to claim 2 wherein, said inner band is attached to said outer band at its medial point diametrically opposed to said distal portions.

9. A rotary tool according to claim 6 wherein, said guide channel includes an elongated slot disposed substantially tangentially of said inner band distal portions.

* * * * *